US006378787B1

(12) United States Patent
Büchi et al.

(10) Patent No.: US 6,378,787 B1
(45) Date of Patent: Apr. 30, 2002

(54) COMBINED PRESSURE ATOMIZING NOZZLE

(75) Inventors: Franz Büchi, Unterehrendingen (CH); Uwe Hoferer, Bad Peterstal; Peter Jansohn, Küssaberg, both of (DE); Christian Steinbach, Neuenhof (CH)

(73) Assignee: Alstom, Paris (FR)

( * ) Notice: Subject to any disclaimer, the term of this patent is extended or adjusted under 35 U.S.C. 154(b) by 76 days.

(21) Appl. No.: 09/152,515

(22) Filed: Sep. 14, 1998

(30) Foreign Application Priority Data

Sep. 15, 1997 (EP) ..... 97810662

(51) Int. Cl.[7] ..... B05B 7/10
(52) U.S. Cl. ..... 239/406; 239/444
(58) Field of Search ..... 239/406, 444, 239/449, 436, 443, 590.3

(56) References Cited

U.S. PATENT DOCUMENTS

| | | | | |
|---|---|---|---|---|
| 478,295 A | * | 7/1892 | Squire et al. | 239/406 |
| 1,339,579 A | * | 5/1920 | Runyan | 239/406 |
| 1,887,407 A | * | 11/1932 | Forney | 239/444 X |
| 3,401,883 A | * | 9/1968 | Gebhardt et al. | 239/406 X |
| 3,785,570 A | | 1/1974 | Krieger | 239/401 |
| 4,116,388 A | * | 9/1978 | Trozzi | 239/406 |
| 5,251,823 A | * | 10/1993 | Joshi et al. | 239/406 X |
| 5,603,456 A | * | 2/1997 | Akimoto et al. | 239/406 |

FOREIGN PATENT DOCUMENTS

| | | |
|---|---|---|
| DE | 324589 | 9/1920 |
| DE | 862599 | 1/1953 |
| EP | 0321809 B1 | 5/1991 |
| EP | 0704657 A2 | 4/1996 |
| EP | 0711953 A2 | 5/1996 |
| FR | 2234931 | 1/1975 |
| FR | 2403517 | 4/1979 |

* cited by examiner

*Primary Examiner*—Robert M. Fetsuga
(74) *Attorney, Agent, or Firm*—Burns, Doane, Swecker & Mathis, L.L.P.

(57) ABSTRACT

A novel combined pressure atomizing nozzle for gas-turbine burners is provided, with which an improved adaptation of the atomizing quality of liquids to the respective load conditions, i.e. good premixing over the entire load range, can be realized.

To this end, the pressure atomizing nozzle comprises a nozzle body (1) having at least two separate feed passages (7, 12) for at least one liquid (14, 29, 31) to be atomized. The first feed passage (7) is at least partly enclosed by the second feed passage (12) and is connected downstream to an outer space (5) via a discharge orifice (11). The second feed passage (12) is likewise connected to the outer space (5), in which case the second feed passage (12) has at least two discharge orifices (13) to the outer space (5).

10 Claims, 6 Drawing Sheets

FIG. 1
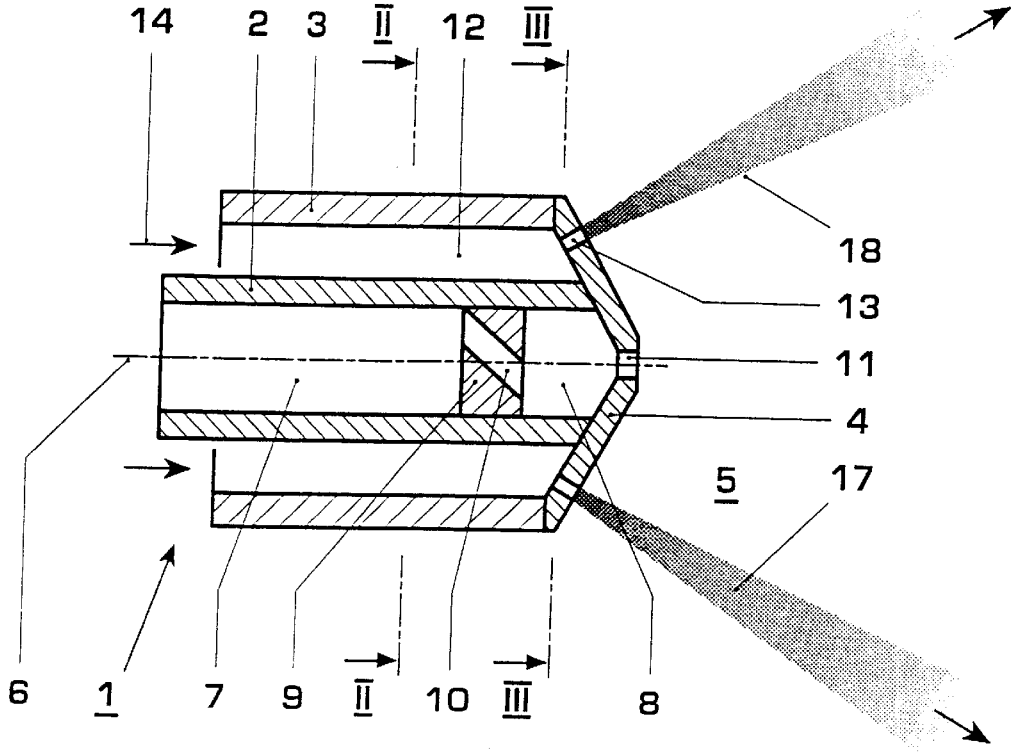
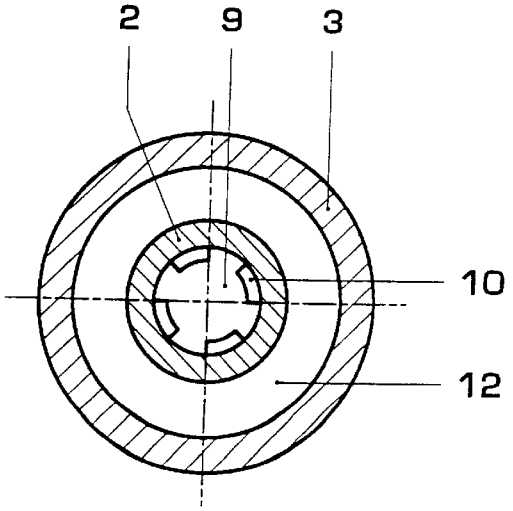
FIG. 2
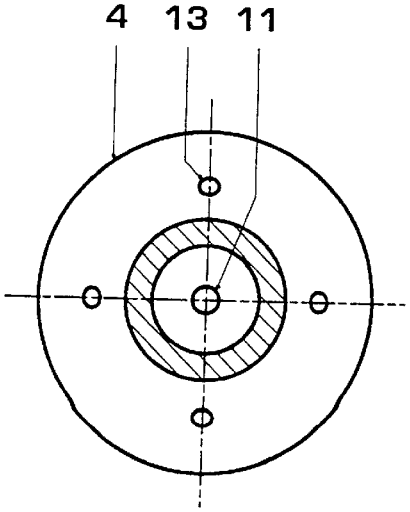
FIG. 3

COMBINED PRESSURE ATOMIZING NOZZLE

BACKGROUND OF THE INVENTION

1. Field of the Invention

The invention relates to a combined pressure atomizing nozzle operated with liquid fuel and intended for gas-turbine burners according to the preamble of claim 1.

2. Discussion of Background

Low-pollution combustion of liquid fuels, such as, for example, extra-light fuel oil, requires the complete vaporization of the fuel droplets and the premixing of the fuel vapor with the combustion air before the flame front is reached. Even small zones of higher fuel concentration lead to elevated temperatures in the reaction zone and thus to intensified formation of thermal nitrogen oxides. A disadvantage of lean premixed flames is that the flame temperatures lie very close to the extinction limit. In order to realize a burner operation which continues to be stable at low load and thus lower flame temperature, specific enrichment of the flame-stabilization zones is necessary. There is therefore the problem of covering a wide operating range of the gas turbine with a burner and an atomizing nozzle.

That depth of penetration of the fuel spray into the combustion air which is required for a good distribution of the fuel in the combustion air is influenced in particular by the ratio of the impulse flows of combustion air and fuel. This ratio changes with the operating conditions, i.e. as a result of changes in the fuel mass flow, in the fuel pressure, and in the temperature and the pressure of the burner air. The vaporization time of the fuel depends essentially on the atomizing quality, the relative velocity between fuel and air, and the ambient boundary conditions such as temperature and pressure. Whereas the latter are predetermined for the different load states by the gas-turbine process, the atomizing quality and the relative velocity are mainly determined by the atomizing nozzle. In conventional gas-turbine burners, spill-controlled swirl atomizers or two-stage swirl atomizers are used in order to compensate for the changing ambient conditions. However, since no specific change in the spraying direction is possible in swirl nozzles, these known atomizing nozzles merely permit a rough adaptation of the atomizing quality and the fuel impulse to the respective load conditions.

An improvement can be achieved with the high-pressure atomizing nozzle disclosed in EP-A2-0 711 953, the discharge orifices of which are oriented to the zones of high air velocity and in which the angle of the fuel spray to the axis of the burner is at least as large as the cone half angle of the burner. As the name reveals, high pressure is required to operate this pressure atomizing nozzle, which is suitable in particular for a double-cone burner disclosed by EP-B1-0321 809. To this end, the liquid fuel must be fed at a pressure of more than 100 bar, which, however, requires a considerable design input for the fuel system. In addition, a change in the spraying direction or in the jet profile is not possible either.

German Patent 862 599 discloses a combined two-stage or multi-stage swirl atomizer, which, however, has an impulse behavior which is unsuitable for gas-turbine burners. Although very fine atomization is achieved with the resulting swirl spray, the fuel impulse is too low to achieve an adequate distribution of the fuel droplets in the combustion air and thus good premixing.

SUMMARY OF THE INVENTION

Accordingly, one object of the invention, in attempting to avoid these disadvantages, is to provide a novel combined pressure atomizing nozzle for gas-turbine burners, with which an improved adaptation of the atomizing quality of liquids to the respective load conditions, i.e. good premixing over the entire load range, can be realized.

According to the invention, this is achieved in that, in a device according to the preamble of claim 1, the second feed passage has at least two discharge orifices to the outer space. As a result, the combined pressure atomizing nozzle is designed as a multi-hole diaphragm nozzle having a simple, central nozzle, which, in addition to the fine atomization of the liquid fuel, also ensures a high burner impulse. In this way, both quick vaporization of the liquid fuel and good premixing of the fuel spray with the combustion air can be achieved, for which reason the pressure atomizing nozzle according to the invention is also suitable in particular for gas-turbine burners. In addition, a pressure atomizing nozzle of relatively simple construction and having a small space requirement is provided, the two-stage arrangement of which is realized only by the additional inclusion of the discharge orifices of the second feed passage.

Compared with the spraying of the liquid fuel via an annular duct (German Patent 862 599), which spraying is disclosed by the prior art, a plurality of separate fuel sprays having a relatively narrow spray cone are produced by the discharge orifices according to the invention. However, these fuel sprays have a markedly higher impulse than an annular fuel spray and also have a higher velocity of the liquid fuel relative to the combustion air. Improved premixing can therefore be achieved with this solution. When the fuel distribution between the diaphragm nozzle and the central nozzle corresponds to the actual operating situation, both specific intermixing between the liquid fuel and the combustion air and an adaptation of the fuel impulse to the requisite depth of penetration of the liquid fuel into the combustion air are made possible with the pressure atomizing nozzle. Such a mass flow of liquid which corresponds to the requisite fuel quantity of the gas turbine at part load is fed to the pressure atomizing nozzle via the central nozzle, i.e. through the first feed passage.

It is especially advantageous if the discharge orifices of the second feed passage are uniformly distributed over the periphery of the nozzle body. This arrangement ensures a uniform fuel concentration in the reaction zone and therefore prevents the intensified formation of nitrogen oxides.

The first feed passage is formed in the interior of a first tube, and the second feed passage is formed in the interior of a second tube. Both tubes are arranged concentrically to one another and are closed off from the outer space downstream by a cover. The cover and the first tube are designed in one piece. As a result, the pressure atomizing nozzle can be assembled in a relatively simple manner by the second tube being pushed onto the first tube up to its stop at the cover. The second tube and the cover are then firmly connected to one another, for example by welding.

A turbulence chamber is advantageously formed directly upstream of the discharge orifices of the second feed passage. The atomization of the liquid fuel can be improved by the additional inclusion of the turbulence chamber in the multi-hole diaphragm nozzle. The turbulence chamber is separated from the second feed passage by a partition. At least two turbulence-generating orifices are arranged in the partition eccentrically with respect to the second feed passage. With such asymmetrical directing of the liquid fuel into the turbulence chamber, higher turbulence can be achieved and, as a result, the atomization of the liquid fuel can be further improved.

In an especially advantageous manner, the turbulence-generating orifices are arranged offset from the discharge orifices of the second feed passage. In this case, the offset, in the case of four turbulence-generating orifices or discharge orifices respectively, is preferably about 45°, so that the turbulence-generating orifices are arranged exactly centrally between the discharge orifices. This leads to a more intensive, small-scale and turbulent structure, i.e. to a very fine fuel spray.

The pressure atomizing nozzle constructed with the additional turbulence chamber can likewise be assembled in a relatively simple manner. To this end, the cover, the first tube and the partition are designed in one piece, so that these components can be inserted together, as an insert so to speak, into the second tube. Finally, the first tube and the cover are firmly connected to one another, for example by welding.

As an alternative to a simple, central nozzle, either a swirl chamber or a turbulence chamber is formed between the first feed passage and the discharge orifice. In the first case, i.e. when using a swirl nozzle, a swirl spray having a relatively wide spray cone is produced, so that a high fuel concentration in the center of the burner as well as sufficient vaporization of the fuel can also be achieved at part load. This also permits a stable burner operation in the part-load range of the gas turbine. If, on the other hand, a turbulence nozzle is used as central nozzle, a narrower spray angle can be realized while the atomization of the liquid fuel remains equally effective. In this way, the fuel concentration in the center of the burner can be further increased and the burner operation can thereby be additionally stabilized at part load.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing of a combined pressure atomizing nozzle for gas-turbine burners, wherein:

FIG. 1 shows a partial longitudinal section of the pressure atomizing nozzle, including the representation of the fuel spray during full-load operation;

FIG. 2 shows a cross section through the pressure atomizing nozzle according to FIG. 1 along line II—II;

FIG. 3 shows a cross section through the pressure atomizing nozzle according to FIG. 1 along line III—III;

Figure 4:
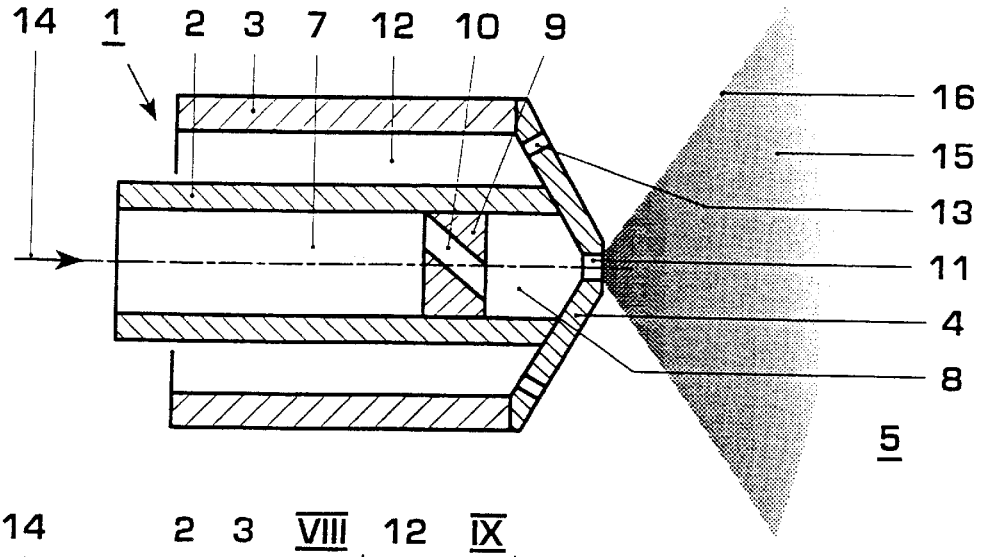
FIG. 4 shows a representation according to FIG. 1 but with a representation of the fuel spray during part-load operation.

Only the elements essential for the understanding of the invention are shown. Not shown, for example, is the gas-turbine burner accommodating the pressure atomizing nozzle. The direction of flow of the working media is designated by arrows.

DESCRIPTION OF THE PREFERRED EMBODIMENTS

Referring now to the drawings, wherein like reference numerals designate identical or corresponding parts throughout the several views, the gas-turbine burner (not shown) which accommodates the pressure atomizing nozzle is designed, for example, as a double-cone burner as disclosed by EP-B1-0 321 809. Of course, the pressure atomizing nozzle is in principle also suitable for other gas-turbine burners, thus, for example, for the burner disclosed by EP-A2-0 704 657 and consisting of a swirl generator with adjoining mixing section. The pressure atomizing nozzle has a nozzle body 1 having two tubes 2, 3 which are arranged concentrically to one another and are closed off from an outer space 5 downstream by a conical cover 4. In this case, the outer space 5 of the pressure atomizing nozzle is at the same time the inner space of the gasturbine burner. The nozzle body 1 has a longitudinal axis 6, which coincides with the longitudinal axis (not shown) of the gas-turbine burner.

The first, inner tube 2 encloses a first, inner feed passage 7, adjoining which downstream is a swirl chamber 8. The swirl chamber 8 is defined on the outside by the inner tube 2, on the downstream side by the cover 4 and on the upstream side by an insert 9 (FIG. 1). It is connected to the inner feed passage 7 via tangentially positioned swirl passages 10 (FIG. 2) arranged in the insert 9 and to the outer space 5 via a discharge orifice 11. The discharge orifice 11 is arranged in the longitudinal axis 6 of the nozzle body 1. The second, outer tube 3 has a larger diameter than the inner tube 2, so that a second, outer feed passage 12 designed as an annular space is arranged between both tubes 3, 2. The feed passage 12 is likewise connected to the outer space 5 via four discharge orifices 13 located in the cover 4. The discharge orifices 13 are uniformly distributed over the periphery of the nozzle body 1 (FIG. 3) and oriented in such a way that they spray into the wake of the swirl generator of the burner (not shown). The exact orientation depends on the boundary conditions of the gas turbine. It remains to be noted that the number of discharge orifices 13 is not fixed at four, but there must be at least two discharge orifices 13 for a uniform fuel distribution. A pressure atomizing nozzle of such a design is especially suitable for swirl generators having a conical shape.

The cover 4 and the inner tube 2 of the nozzle body 1 are designed in one piece. As a result, the entire pressure atomizing nozzle can be assembled in a relatively simple manner by the outer tube 3 being pushed onto the inner tube 2 up to its stop at the cover 4. The outer tube 3 and the cover 4 are then welded to one another.

During the operation of the gas-turbine burner, a liquid fuel, for example fuel oil, is fed as liquid 14 to be atomized to the pressure atomizing nozzle. As a function of the actual operating situation of the gas turbine, i.e. depending on whether the gas turbine is operated at full load or at part load, the liquid fuel 14 is fed to the gas-turbine burner either via the outer feed passage 12 or via the inner feed passage 7 of the pressure atomizing nozzle. The nozzle body 1 therefore has two different nozzles, namely an outer multi-hole diaphragm nozzle and a central swirl nozzle.

At part load, the liquid fuel 14 is introduced into the inner feed passage 7 of the nozzle body 1, from where it passes in a swirled state via the swirl passages 10 into the swirl chamber 8. The liquid fuel 14 is then sprayed into the outer space 5 via the discharge orifice 11, the swirl nozzle producing a swirl spray 15 having a relatively wide spray cone 16 (FIG. 4). Thus a high fuel concentration in the center of the burner as well as sufficient vaporization of the fuel are also achieved at part load. This also permits a stable burner operation in the part-load range of the gas turbine.

In the exemplary embodiment shown, a central feed of the liquid fuel 14 is effected via the centrally arranged, inner feed passage 7 completely surrounded by the outer feed passage 12. Of course, the inner feed passage 7 may also be arranged eccentrically and/or may also be surrounded only partly by the outer feed passage 12, so that the liquid fuel 14 passes decentrally, but with the same action, to the swirl nozzle (not shown).

In order to achieve a good atomizing quality and a considerable depth of penetration of the jet into the combustion air, the injection pressure is to be up to 100 bar. The maximum mass flow of the liquid fuel 14 is selected according to the load range of the gas turbine to be covered and is normally less than 50% of the mass flow at full load. The gas-turbine burner can therefore also work in premix operation at part load.

On the other hand, at full load, the liquid fuel 14 is introduced into the outer feed passage 12 of the nozzle body 1 and passes via its discharge orifices 13 into the outer space 5. In this way, the multi-hole diaphragm nozzle produces a plurality of fuel sprays 17 corresponding to the number of discharge orifices 13 and having in each case a relatively narrow spray cone 18 (FIG. 1). The separate fuel sprays 17 have a high impulse and also a high velocity of the liquid fuel 14 relative to the combustion air. Good atomization of the liquid fuel 14 is therefore effected with the multi-hole diaphragm nozzle. In addition, the liquid fuel 14 achieves considerable depth of penetration into the combustion air, a factor which leads to a markedly improved intermixing quality. Despite the now improved depth of penetration of the liquid fuel 14 in full-load operation, problems do not occur at part load due to fuel-oil droplets being applied to the wall, since operation is then changed over to the central swirl nozzle.

Figure 5:
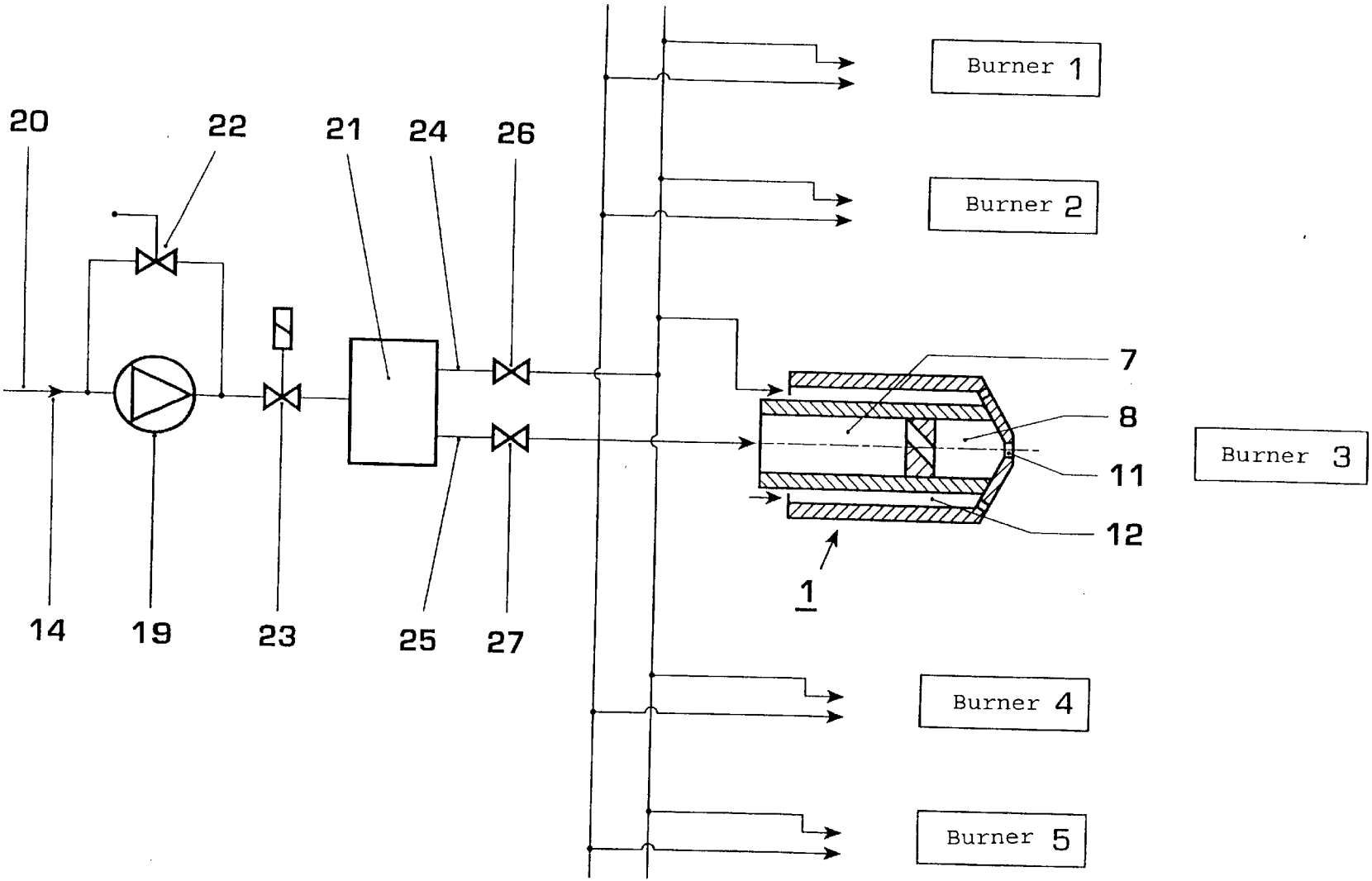
FIG. 5 shows a schematic representation of the liquid-feed system for the pressure atomizing nozzle, liquid fuel (fuel oil) being atomized in each case.

On account of this variable mode of operation by an appropriate liquid-feed system, the pressure atomizing nozzle according to the invention can fulfill the requirements for the fuel spray 15, 17, which differ greatly depending on the actual operating situation. A possible liquid-feed system to the pressure atomizing nozzle is schematically shown in FIG. 5. Via a pump 19, the liquid fuel 14 to be atomized is pumped from a fuel line 20 into a pressure vessel 21. A spill valve 22 serves to set the pump supply pressure. A shut-off valve 23 is arranged in the fuel line 20 between the pump 19 and the pressure vessel 21. Two lines 24, 25 branch off from the pressure vessel 21, the line 24 feeding the second feed passage 12, i.e. the multi-hole diaphragm nozzle, and the line 25 being connected to the first feed passage 7, i.e. to the swirl nozzle. A control valve 26, 27 is in each case arranged in the lines 24, 25, which control valves 26, 27 enable the respective liquid quantity fed to be regulated. Depending on requirement, both control valves 26, 27 may also be open, so that in this case both nozzles are in operation. A smooth changeover is possible between the two nozzles. As indicated in FIG. 5, a plurality of burners of, for example, a gas-turbine combustion chamber can be supplied with liquid fuel 14 via this fuel-feed system. The circuit shown has the advantage that, to control the pressure atomizing nozzle, which consists of two separate nozzles, only the two control valves 26, 27, i.e. only one control valve 26 or 27 per nozzle, are necessary of course, a water/oil emulsion may also be used as fuel in special cases, as a result of which a further reduction in the NOx emissions is possible.

Figure 6:
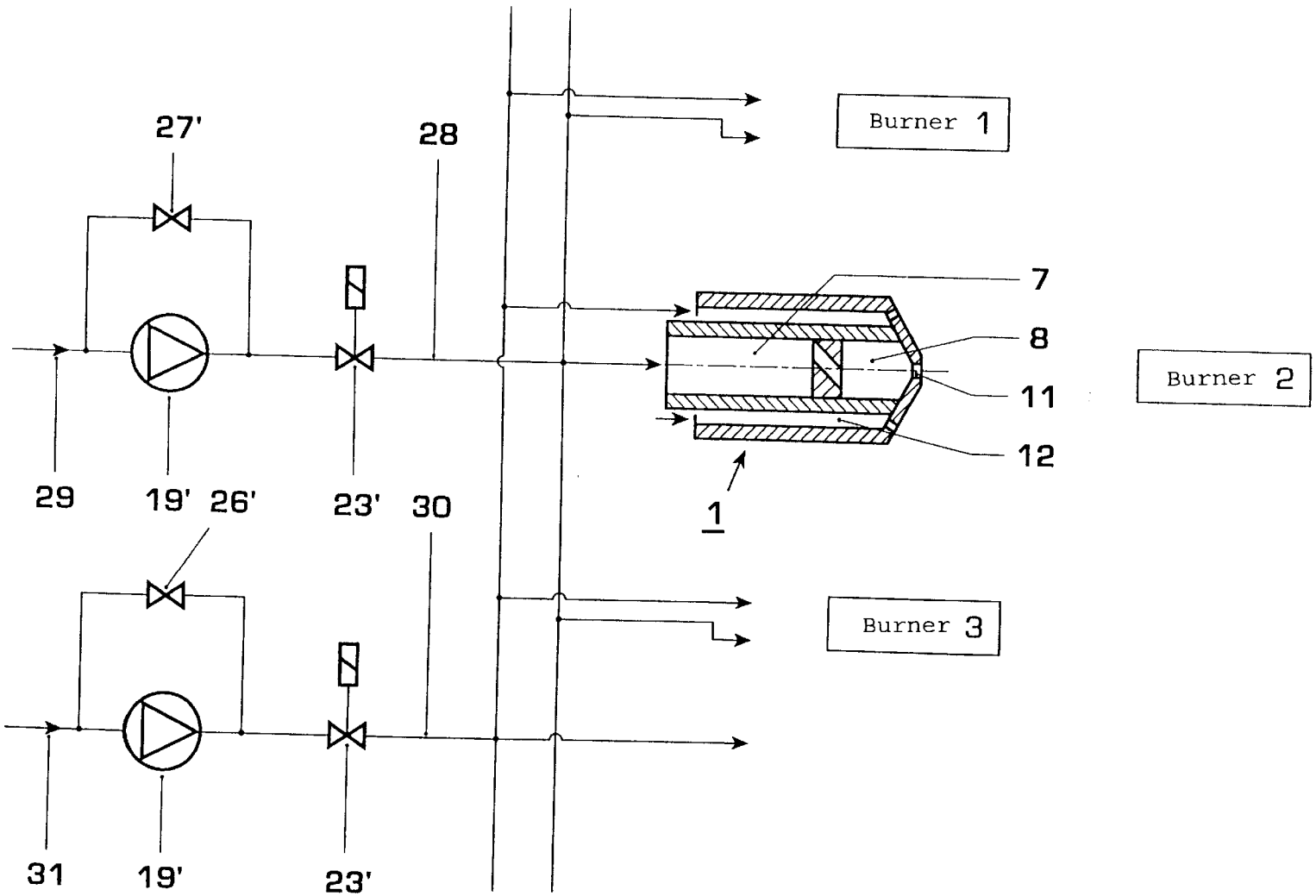
FIG. 6 shows a schematic representation of the liquid-feed system for the pressure atomizing nozzle, different liquids (fuel oil, water) being atomized.

An alternative liquid-feed system is shown in FIG. 6. The pressure atomizing nozzle is fed via a first feed line 28 with water, as a first liquid 29 to be atomized, and via a second feed line 30 with liquid fuel (fuel oil), as a second liquid 31 to be atomized. Arranged in the feed lines 28, 30 are in each case a pump 19' and, downstream, a shut-off valve 23', with which the lines 28, 30 can alternatively be closed. The mass flow of the liquids 29, 31 to be atomized is controlled in each case by means of a control valve 26', 27' arranged in each of the feed lines 28, 30. If, as indicated in FIG. 6, a plurality of burners of, for example, a gas-turbine combustion chamber are supplied with liquid fuel 31 or with water 29 via this liquid-feed system, the pressure atomizing nozzle can be operated during the start or at part load by only fuel oil 31 being atomized via the multi-hole diaphragm nozzle. At higher load or at full load, the gas-turbine burner is then supplied with water 29 via the feed line 28. During the spraying into the inner space (not shown) of the gas-turbine burner, the droplets of the water 29 are mixed with those of the fuel oil 31, a factor which leads to a reduction in the NOx emissions. Here, too, it turns out to be an advantage that in each case only one control valve 26', 27' per nozzle, of the pressure atomizing nozzle, and a total of only one feed line 30 for the liquid fuel 31 are required for the gas-turbine operation.

The gas-turbine burner equipped with the pressure atomizing nozzle according to the invention can be operated with a plurality of different liquid fuels 31 as well as with a liquid fuel 31 and with water 29, with only a liquid fuel 31 or even with liquid-fuel/water mixtures. They therefore permit a relatively large range of use and can be adapted to changed operating conditions. During operation of the multi-hole diaphragm nozzle, the liquid 14, 31 passed through this multi-hole diaphragm nozzle flows constantly around the central swirl nozzle. Therefore, during the changeover action from full to part load, as is the case, for example, during a load loss, no cooling-down of the swirl nozzle is necessary, so that a quick load change can be ensured.

Figure 7:
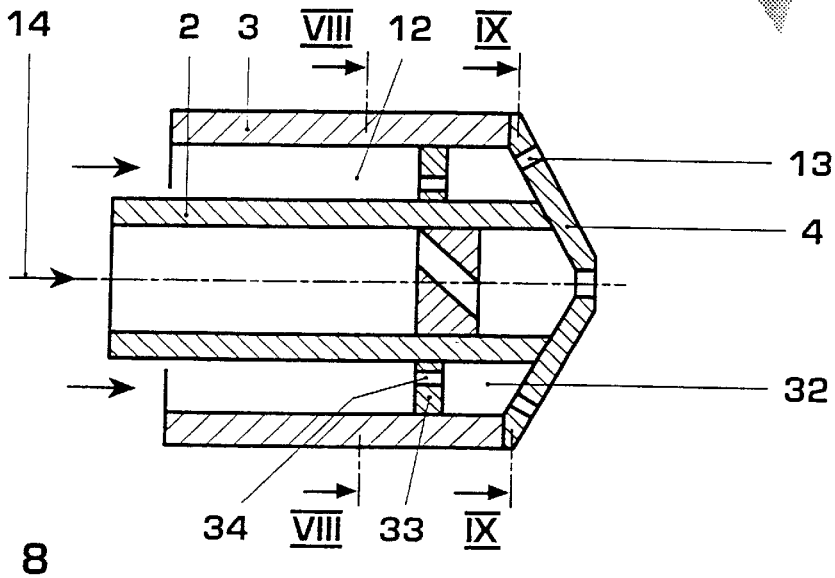
FIG. 7 shows a partial longitudinal section of a pressure atomizing nozzle having a turbulence chamber in the outer feed passage.

In a next exemplary embodiment, a turbulence chamber 32 is formed directly upstream of the discharge orifices 13 of the outer feed passage 12. The turbulence chamber 32 is separated from the outer feed passage 12 by a partition 33. In the partition 33, four turbulence-generating orifices 34 are formed eccentrically with respect to the outer feed passage 12 (FIG. 7). When a pressure atomizing nozzle having the additional turbulence chamber 32 of the outer feed passage 12 is used, the liquid fuel 14 is sprayed as a highly turbulent jet via the discharge orifices 13 into the inner space of the gas-turbine burner, where it subsequently disintegrates into a fine fuel spray 17. The premixing of the gas-turbine burner can thus be further improved.

Figure 8:
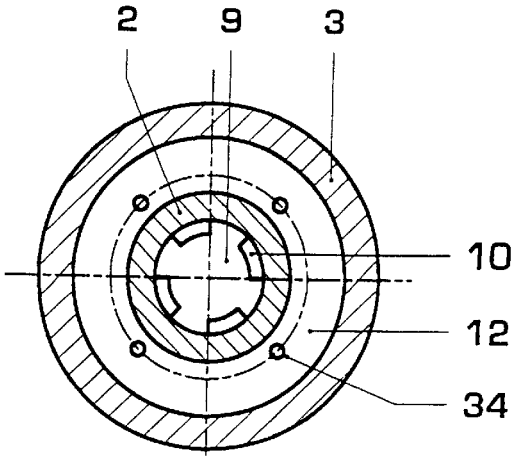
FIG. 8 shows a cross section through the pressure atomizing nozzle according to FIG. 7 along line VIII—VIII.
Figure 9:
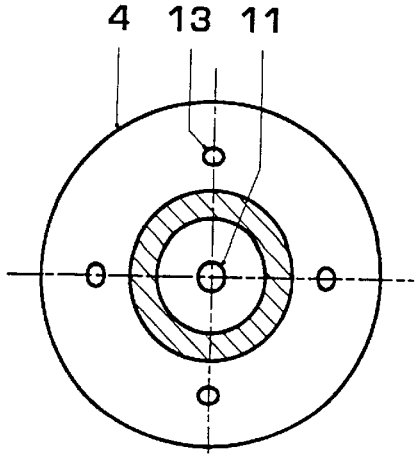
FIG. 9 shows a cross section through the pressure atomizing nozzle according to FIG. 7 along line IX—IX.

As can easily be seen when comparing FIGS. 8 and 9, the turbulence-generating orifices 34, with respect to the main flow direction of the liquid fuel 14, are arranged offset from the discharge orifices 13 of the outer feed passage 12 at an angle of 45°. As a result, in each case one of the turbulence-generating orifices 34 is arranged centrally between two discharge orifices 13 adjacent to one another. With this measure, the turbulent structure of the liquid fuel 14 becomes more intensive on the one hand and becomes small scale on the other hand. Therefore a turbulent, rapidly disintegrating free jet discharges from the multi-hole diaphragm nozzle. The number of discharge orifices 13 or turbulence-generating orifices 34 respectively may of course also be different from four, in which case the angle described then changes accordingly.

The cover 4, the inner tube 2 and the partition 33 of the nozzle body 1 are designed in one piece (FIG. 7). As a result, this pressure atomizing nozzle can also be assembled in a relatively simple manner by the outer tube 3 being pushed onto the inner tube 2 up to its stop at the cover 4. The outer tube 3 is then welded to both the cover 4 and the partition 33.

Figure 10:
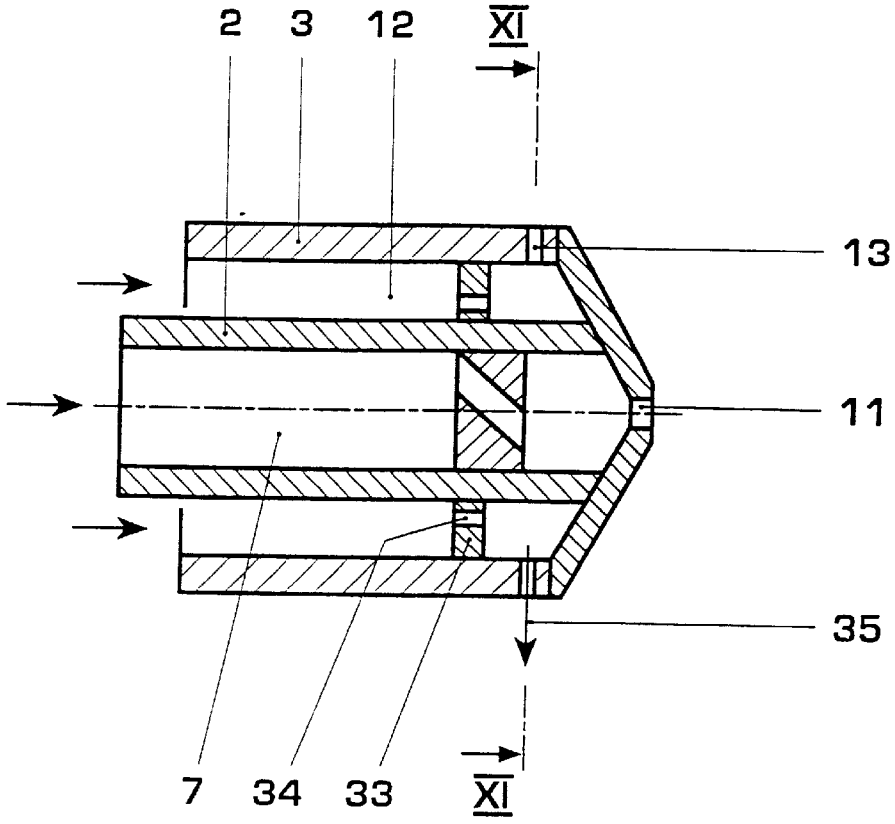
FIG. 10 shows a partial longitudinal section of a pressure atomizing nozzle having radial discharge orifices of the outer feed passage.
Figure 11:
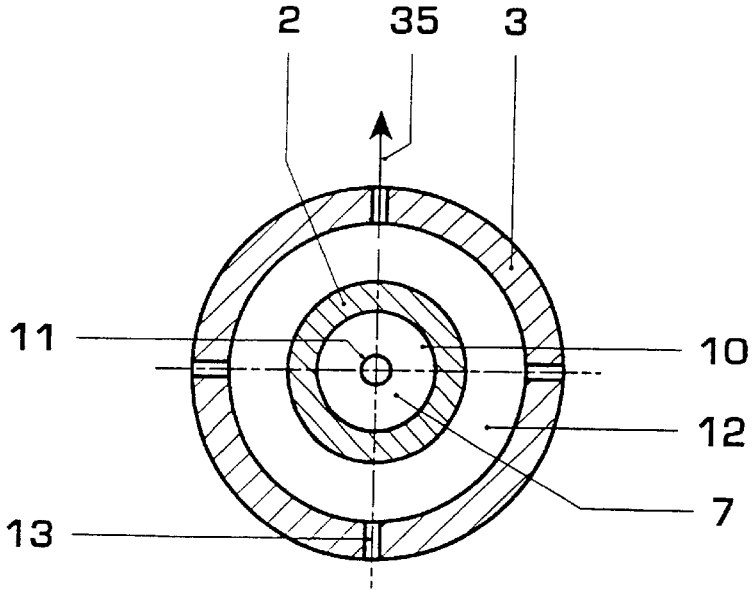
FIG. 11 shows a cross section through the pressure atomizing nozzle according to FIG. 10 along line XI—XI

In a further exemplary embodiment, the discharge orifices 13 of the outer feed passage 12 have a radial discharge direction 35 (FIG. 10, FIG. 11), a factor which is suitable in particular for axial swirl generators. In particular in the case of an axially parallel incident flow of the pressure atomizing nozzle, this leads to a great depth of penetration of the fuel spray 17 into the combustion air and thus to an additional improvement in the premixing of the gas-turbine burner.

Figure 12:
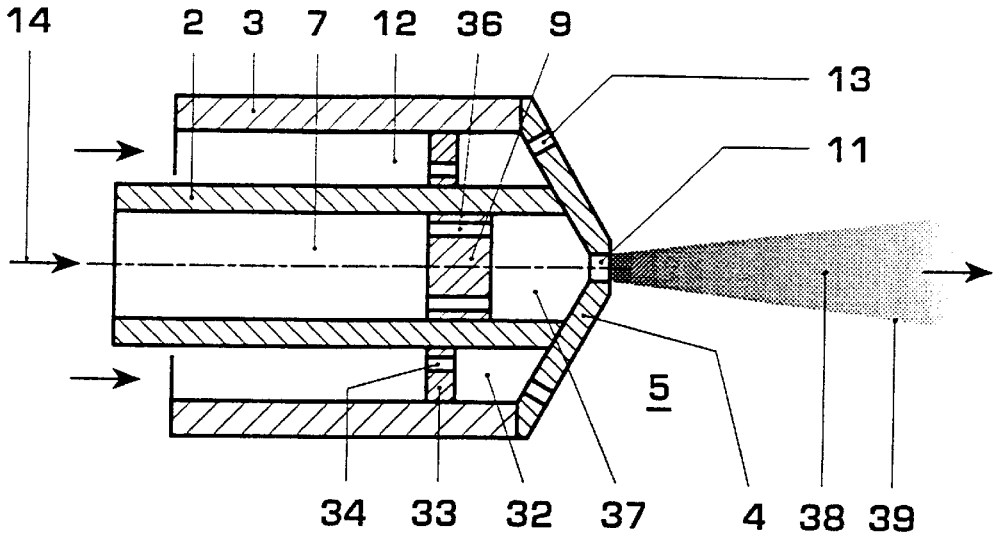
FIG. 12 shows a partial longitudinal section of a pressure atomizing nozzle according to a next exemplary embodiment, during part-load operation.

As an alternative to the design of the swirl passages 10, turbulence passages 36 are arranged in the insert 9 in a next exemplary embodiment. These turbulence passages 36 lead into a turbulence chamber 37, which in turn is connected to the outer space 5 via the discharge orifice 11 (FIG. 12). During part-load operation of this pressure atomizing nozzle consisting of a multi-hole diaphragm nozzle and a central turbulence nozzle, a rapidly disintegrating fuel spray 38 having an especially narrow spray cone 39 is produced. As a result, the fuel concentration in the center of the burner can also be further increased at part load of the gas turbine.

Figure 13:
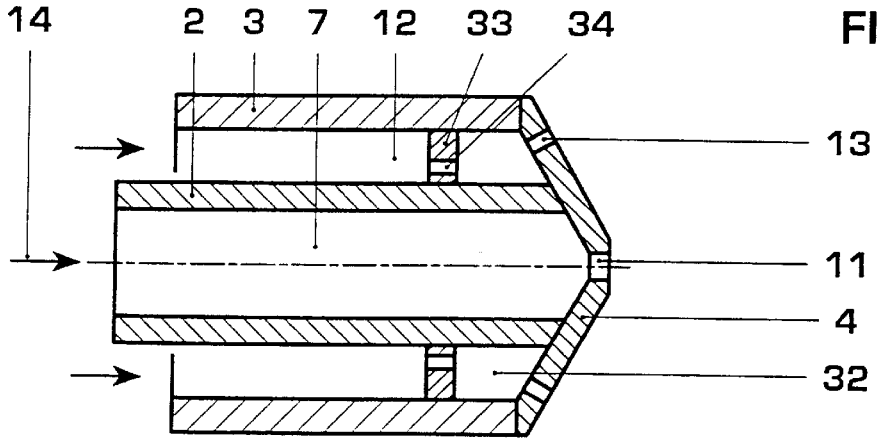
FIG. 13 shows a partial longitudinal section of a pressure atomizing nozzle according to a further exemplary embodiment.

The pressure atomizing nozzle may of course also be designed without an insert 9, so that the first feed passage 7 extends directly up to the cover 4 (FIG. 13). In this case, an especially simple, central nozzle having a small space requirement and a function essentially analogous to that of the central nozzles of the exemplary embodiments described above is obtained.

Figure 14:
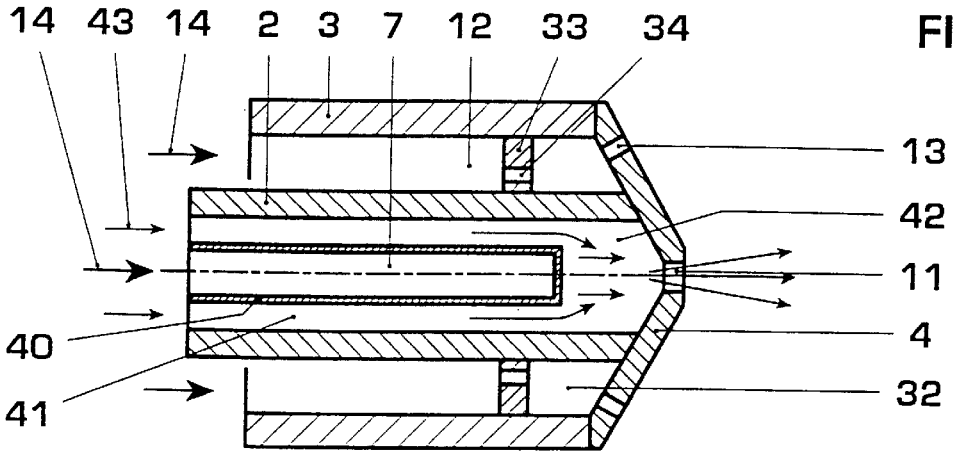
FIG. 14 shows a partial longitudinal section of a pressure atomizing nozzle according to a further exemplary embodiment, during part-load operation.

In a further exemplary embodiment, which likewise does not need the insert 9, a third tube 40 is arranged in the interior of the first tube 2 and concentrically to the latter, and this third tube 40 ends upstream of the discharge orifice 11 and accommodates the inner feed passage 7. The first and the third tubes 2, 40 are at a distance from one another, so that a free space 41 designed as an air passage is obtained between them. The air passage 41 widens downstream of the third tube 40 to form a mixing space 42, into which the feed passage 7 leads (FIG. 14). During operation of this central nozzle, air 43 is fed in via a feed line (not shown) and via the air passage 41. In the mixing space 42, the air 43 strikes the liquid fuel 14, as a result of which the latter is sprayed in an air-assisted manner into the outer space 5 of the pressure atomizing nozzle, i.e. into the inner space of the gas-turbine burner. Thus the requisite atomizing quality is achieved irrespective of the current fuel flow rate, a factor which is of advantage in particular during part-load operation.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A liquid fuel pressure atomizing nozzle for gas-turbine burners, comprising a nozzle body having at least two separate feed passages for one liquid to be atomized, the first feed passage being at least partly enclosed by the second feed passage and also being connected downstream to an outer space via a discharge orifice, and the second feed passage likewise being connected to the outer space, wherein the second feed passage has at least two discharge orifices to the outer space wherein an axis of each of said at least two discharge orifices are oriented outwardly from a central axis of said first feed passage.

2. The liquid fuel pressure atomizing nozzle as claimed in claim 1, wherein the discharge orifices of the second feed passage are uniformly distributed over the periphery of the nozzle body.

3. The liquid fuel pressure atomizing nozzle as claimed in claim 1, wherein the first feed passage is formed in the interior of a first tube, the second feed passage is formed in the interior of a second tube, both tubes are arranged concentrically to one another and are closed off from the outer space downstream by a cover, the cover and the first tube being designed in one piece.

4. The liquid fuel pressure atomizing nozzle as claimed in claim 1, wherein a turbulence chamber is formed directly upstream of the discharge orifices of the second feed passage.

5. The liquid fuel pressure atomizing nozzle as claimed in claim 4, wherein the turbulence chamber is separated from the second feed passage by a partition, and at least two turbulence-generating orifices are arranged in the partition.

6. The liquid fuel pressure atomizing nozzle as claimed in claim 1, wherein the turbulence-generating orifices are formed in the partition eccentrically arranged with respect to the second feed passage.

7. The liquid fuel pressure atomizing nozzle as claimed in claim 6, wherein the turbulence-generating orifices are arranged offset from the discharge orifices of the second feed passage.

8. The liquid fuel pressure atomizing nozzle as claimed in claim 7, wherein in each case one of the turbulence-generating orifices is arranged centrally between two adjacent discharge orifices.

9. The liquid fuel pressure atomizing nozzle as claimed in claim 4, wherein the first feed passage is formed in the interior of a first tube, the second feed passage is formed in the interior of a second tube, both tubes are arranged concentrically to one another and are closed off from the outer space downstream by a cover, the cover, the first tube and the partition being designed in one piece.

10. The liquid fuel pressure atomizing nozzle as claimed in claim 1, wherein a swirl chamber or a turbulence chamber is formed between the first feed passage and the discharge orifice.

* * * * *